US010961877B2

(12) United States Patent
Wyatt et al.

(10) Patent No.: US 10,961,877 B2
(45) Date of Patent: Mar. 30, 2021

(54) APPARATUS AND METHOD FOR A HYDRAULIC VALVETRAIN SYSTEM

(71) Applicant: JAGUAR LAND ROVER LIMITED, Warwickshire (GB)

(72) Inventors: Bethan Wyatt, Coventry (GB); John Hartill, Coventry (GB); Jonathan Saunders, Coventry (GB); Matthew Child, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 0 days.

(21) Appl. No.: 16/482,282

(22) PCT Filed: Jan. 29, 2018

(86) PCT No.: PCT/EP2018/052083
§ 371 (c)(1),
(2) Date: Jul. 31, 2019

(87) PCT Pub. No.: WO2018/141676
PCT Pub. Date: Aug. 9, 2018

(65) Prior Publication Data

US 2020/0003087 A1 Jan. 2, 2020

(30) Foreign Application Priority Data

Feb. 6, 2017 (GB) ..... 1701895

(51) Int. Cl.
*F01L 1/14* (2006.01)
*F01L 9/02* (2006.01)
(Continued)

(52) U.S. Cl.
CPC ..... *F01L 9/02* (2013.01); *F01M 5/02* (2013.01); *F01M 9/10* (2013.01)

(58) Field of Classification Search
CPC ..... F01M 5/025; F01M 5/02; F01M 5/00; F01M 9/10; F01M 9/106;
(Continued)

(56) References Cited

U.S. PATENT DOCUMENTS 6,530,350 B2 * 3/2003 Chiappini ..... F01L 9/021 123/198 F

FOREIGN PATENT DOCUMENTS

EP 1243761 A1 9/2002
EP 1544421 A2 6/2005
(Continued)

OTHER PUBLICATIONS

Combined Search and Examination Report under Sections 17 and 18(3) for Application No. GB1701895.3 dated Jun. 20, 2017.
(Continued)

*Primary Examiner* — Zelalem Eshete
(74) *Attorney, Agent, or Firm* — Carlson, Gaskey & Olds

(57) ABSTRACT

Apparatus (10) for a hydraulic valvetrain system (90) comprising: a first oil retaining means 5 (12), a second oil retaining means (20) and an oil conveyance means (14, 16) having a first end (18) operably connected to the first oil retaining means (12) and a second end (22) operably connected to the second oil retaining means (20). The second oil retaining means (20) is configured to receive oil from the first oil retaining means (12) via the oil conveyance means (14, 16), the first oil retaining means (12) is configured to receive oil from the oil 10 conveyance means (14, 16) and the oil conveyance means (14, 16) is configured to receive oil from the second oil retaining means (20).

15 Claims, 4 Drawing Sheets

(51) Int. Cl.
*F01M 5/02* (2006.01)
*F01M 9/10* (2006.01)

(58) Field of Classification Search
CPC ..... F01M 2005/028; F01L 9/021; F01L 9/02; F01L 2001/34446
See application file for complete search history.

(56) References Cited

FOREIGN PATENT DOCUMENTS

| | | |
|---|---|---|
| GB | 303031 | 3/1930 |
| GB | 404426 | 1/1934 |
| WO | 2004/102008 A2 | 11/2004 |

OTHER PUBLICATIONS

International Search Report and Written Opinion of the International Searching Authority for International application No. PCT/EP2018/052083 dated Apr. 20, 2018.

* cited by examiner

APPARATUS AND METHOD FOR A HYDRAULIC VALVETRAIN SYSTEM

TECHNICAL FIELD

The present disclosure relates to an apparatus and method for a hydraulic system. In particular, but not exclusively, it relates to an apparatus and method for preventing drain down of oil in a hydraulic system where there are running clearances in a hydraulic actuator. In particular, but not exclusively, it relates to an apparatus and method for preventing drain down of oil in a hydraulic valvetrain system.

Aspects of the invention relate to an apparatus for a hydraulic valvetrain system, a method of retaining oil in a hydraulic valvetrain system, a hydraulic valvetrain system, an internal combustion engine and a vehicle.

BACKGROUND

Continuously variable valve lift systems include hydraulic valvetrain systems for internal combustion engines that convert camshaft lift into valve lift. Such hydraulic valvetrain systems may comprise moving parts providing leakage paths, along which oil, which is maintained in a pressure chamber associated with the moving parts, may flow. The leakage paths allow drainage of oil from the pressure chamber over time. In order for valve lift to be achieved, oil must be present in the pressure chamber of the hydraulic valvetrain system.

During cranking of the internal combustion engine, oil will be replenished in the pressure chamber, thus allowing valve lift to be achieved. However, if the pressure chamber is significantly drained of oil, several cranking attempts may be required to replenish the oil in the pressure chamber.

It is an aim of the present invention to address disadvantages associated with the prior art.

SUMMARY OF THE INVENTION

Aspects and embodiments of the invention provide an apparatus for a hydraulic valvetrain system, a method of retaining oil in a hydraulic valvetrain system, a hydraulic valvetrain system, an internal combustion engine and a vehicle as claimed in the appended claims.

According to an aspect of the invention there is provided an apparatus for a hydraulic valvetrain system comprising: a first oil retaining means, a second oil retaining means and an oil conveyance means having a first end operably connected to the first oil retaining means and a second end operably connected to the second oil retaining means; wherein in use, the second oil retaining means receives oil from the first oil retaining means via the oil conveyance means during operation of the hydraulic valvetrain system and the first oil retaining means receives oil from the oil conveyance means following cessation of operation of the hydraulic valvetrain system, wherein upon contraction of the oil volume during reduction of oil temperature, oil from the second oil retaining means passes into the oil conveyance means to prevent air entering the hydraulic valvetrain system.

An advantage of the invention is that improved fluid retention in the apparatus may be provided by providing the interconnected fluid retaining means to facilitate a pressure balanced system when at least partially filled with fluid. An advantage of the invention is the minimisation of fluid loss in the apparatus.

Oil retention in the hydraulic valvetrain system is improved such that the hydraulic valvetrain system will remain primed such that valve lift can be achieved immediately upon start up. For example, when applied to a hydraulic valvetrain system in an internal combustion engine, the invention provides the advantage of allowing valve lift to be achieved immediately upon start up of the internal combustion engine.

The fluid may be a viscous liquid, such as oil. The fluid may be oil operable for lubrication or operation of an internal combustion engine.

The hydraulic valvetrain system may be comprised in an internal combustion engine. The hydraulic valvetrain system may be comprised in a continuous variable valve lift system which allows variation in engine cylinder valve opening height, and/or variation in valve opening and closing timing.

The second oil retaining means may be at least partially located below the first oil retaining means.

This provides the advantage of assisting in the creation of a pressure balance within the hydraulic valvetrain system, in particular between the first oil retaining means and the second oil retaining means.

The oil conveyance means may comprise a first oil conveyance means and a second oil conveyance means.

The first oil conveyance means may be an oil discharge line, oil discharge port, a de-aeration line, or a de-aeration gallery. The function of the first oil conveyance means is for transportation of oil to and from the first oil retaining means. The first oil conveyance means is for de-aeration of oil, that is, to allow air to be separated out from the oil.

The second oil conveyance means may be a tube, hose or conduit. The function of the second oil conveyance means is for transportation of oil to and from the second oil retaining means and for transportation of oil to and from the first oil conveyance means. Therefore, oil can be transported from the first oil retaining means to the second oil retaining means via the first oil conveyance means and the second oil conveyance means, and/or oil can be transported from the second oil retaining means to the first oil retaining means via the first oil conveyance means and the second oil conveyance means.

The first oil retaining means may be a first oil reservoir. The function of the first oil retaining means may be to hold or retain oil for an associated valve and/or other functionally connected components, such as pistons. The first oil retaining means may be called a middle pressure chamber and may be connected to a valve, such as a solenoid valve for actuating an engine component, such as a brake unit or engine valve.

The second oil retaining means may be a second oil reservoir. The function of the second oil retaining means may be to hold or retain oil as a reservoir for the first oil retaining means. In particular, the second oil retaining means may hold or retain oil as a reservoir for the first oil retaining means once the hydraulic valvetrain system ceases to operate, such that oil from the second oil retaining means can be drawn up through the second oil conveyance means towards the first oil conveyance means and towards the first oil retaining means.

In some embodiments, oil may be drawn up from the second oil retaining means through the second oil conveyance means and through the first oil conveyance means. In some embodiments, oil may be drawn up from the second oil retaining means through the second oil conveyance means, through the first oil conveyance means and into the first oil retaining means.

The first oil retaining means may comprise an oil flow aperture through which oil can pass.

The first oil retaining means may be operably connected to one or more of a valve, a piston, and a brake unit, via the oil flow aperture, wherein the connection between the first oil retaining means and the one or more of the valve, piston, and brake unit may provide an oil flow path. The oil flow path may allow flow of oil through the one or more of the valve, piston, and brake unit during engine operation.

This provides the advantage that a connected component, for example in the form of a valve and/or a component operably connected to the valve, such as a piston and/or brake unit, can be provided with oil for lubrication and correct component operation. A valve, and/or piston, and/or brake unit, which is operably connected to the first oil retaining means may have a finite clearance between its relatively moving parts for the correct functioning of the respective valve, and/or piston, and/or brake unit, which then provides an oil leakage path through which oil passing through the oil flow aperture can pass during engine standstill. That is, the running clearances of the one or more of the valve, piston and/or brake unit facilitates leakage of oil through said one or more of the valve, piston and/or brake unit during engine standstill.

The first oil conveyance means may allow oil to pass into and out of the first oil retaining means. A purpose of the first oil conveyance means is to allow aerated oil to pass from the first oil retaining means out through the first oil conveyance means during running of the engine, and to allow de-aerated oil to pass from the first oil conveyance means to the first oil retaining means following engine stop.

The second oil retaining means may comprise a base and side wall, providing a receptacle to hold or retain oil, with an open top to allow egress of oil from the second oil retaining means to an engine sump, in use. The engine sump is located below the level of the second oil retaining means, such that oil flowing out from the open top of the second oil retaining means flows under gravitational force or action to the engine sump, for further operation in the lubrication of engine components. The base of the second oil retaining means may be non-permeable, or non-porous, to ensure that there is no leakage of oil from the receptacle, except via the open top portion of the second oil retaining means.

This provides the advantage of allowing retention of a volume of oil to aid in the creation of a pressure balance between the first oil retaining means and the second oil retaining means on engine stop. A further advantage is that the retention of a volume of oil in the open top receptacle of the second oil retaining means allows de-aeration of oil within the second oil retaining means.

The second end of the second oil conveyance means comprises an opening, the opening being located below the top of the second oil retaining means (20).

The opening of the second oil conveyance means may be adjacent to the base of the second oil retaining means but not abutting the base as it needs to perform the function of allowing oil retained in the second oil retaining means to pass therethrough. A gap between the opening and the base of the second oil retaining means is required to allow substantially free flow of viscous fluid such as oil from the opening into the second oil retaining means and/or from the second oil retaining means through the opening.

The retainable level of oil in the second oil retaining means above the level of the opening may be such that, in use, a retained volume of oil above the opening is greater than the oil contraction volume in the hydraulic valvetrain system between a maximum oil temperature and a minimum oil temperature.

Therefore the volume of the second oil retaining means, above the level of the opening, may be greater than a maximum oil contraction volume. Functionally, the oil level in the second oil retaining means above the level of the opening should provide an oil volume greater than the oil contraction volume in the hydraulic valvetrain system over an application specific temperature range to prevent drawing in of air which would lead to drainage of the oil from the first oil retaining means.

In other words, the altitude or elevation of the oil level in the second oil retaining means may be higher than the level of the opening in the second end of the second oil conveyance means such that the volume of oil in the second oil retaining means above the opening is greater than the oil contraction volume over an application specific temperature range, which may be the temperature range experience by the oil between a maximum temperature of the oil during engine operation and a minimum temperature of the oil following engine stop or shutoff.

In some non-limiting examples, the difference between a maximum oil temperature and a minimum oil temperature may be between 60° C. and 180° C. The difference between a maximum oil temperature and a minimum oil temperature may be between 100° C. and 140° C. For example, the difference between a maximum oil temperature and a minimum oil temperature may be 120° C. The difference between the maximum oil temperature and minimum oil temperature depends on the application. It should be understood that the oil contraction volume will be a function of the difference between the maximum oil temperature and minimum oil temperature and also of the internal volume of the components including the first oil retaining means, first oil conveyance means and second oil conveyance means. It should also be understood that different specifications of oil would have different expansion and contraction characteristics over a given temperature range.

The second oil retaining means may be arranged or configured to provide, in use, a pressure balance to prevent oil leakage through the oil flow aperture. In particular to prevent oil leakage through the oil flow aperture on engine standstill. Engine standstill is a condition of the engine following engine shutoff or stop. In particular, engine standstill is a condition of the engine following completion of the oil cooling cycle of the engine following engine shutoff or stop. The pressure balance may be a hydrostatic pressure balance.

The apparatus may comprise a plurality of first oil retaining means operably connected to the first oil conveyance means.

According to an aspect of the invention there is provided a method of retaining oil in a hydraulic valvetrain system comprising: receiving, in a second oil retaining means during operation of the hydraulic valvetrain system, oil from a first oil retaining means via an oil conveyance means, the oil conveyance means having a first end operably connected to the first oil retaining means and a second end operably connected to the second oil retaining means, and receiving, in the first oil retaining means following cessation of operation of the hydraulic valvetrain system, oil from the foil conveyance means, wherein, upon contraction of the oil volume during reduction of oil temperature, oil from the second oil retaining means passes into the oil conveyance means to prevent air entering the hydraulic valvetrain system.

According to an aspect of the invention there is provided a hydraulic valvetrain system comprising an apparatus as defined in the preceding paragraphs.

According to an aspect of the invention there is provided an internal combustion engine comprising an apparatus as defined in the preceding paragraphs or a hydraulic valvetrain system as defined in the preceding paragraphs.

According to an aspect of the invention there is provided a vehicle comprising an apparatus as defined in the preceding paragraphs, a hydraulic valvetrain system as defined in the preceding paragraphs, or an internal combustion engine as defined in the preceding paragraphs.

According to an aspect of the invention there is provided an apparatus for a hydraulic valvetrain system comprising: a first oil reservoir; an oil discharge line operably connected to the first oil reservoir; a tube having a first end operably connected to the oil discharge line; and a second oil reservoir; wherein a second end of the tube is located within the second oil reservoir.

This provides the advantage of improved oil retention in the hydraulic valvetrain system thus the hydraulic valvetrain system will remain primed such that valve lift can be achieved immediately upon start up of an associated internal combustion engine.

The apparatus may be for continuously variable valve lift arrangements, for example for a continuously variable valve lift arrangement in an internal combustion engine.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
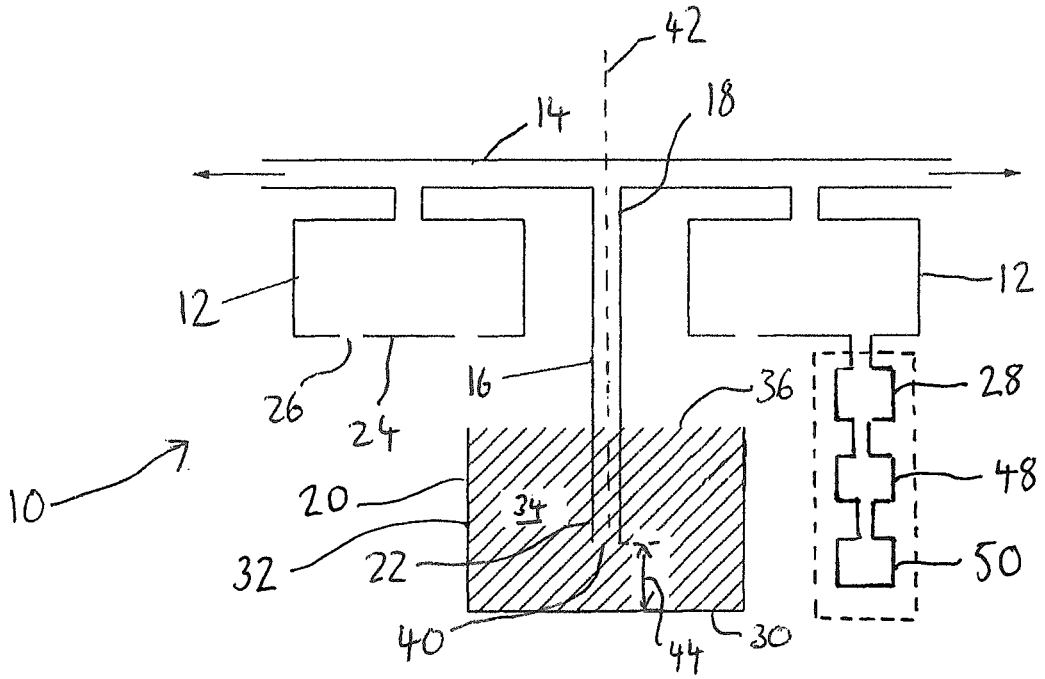
FIG. 1 illustrates a schematic view of an apparatus.

Examples of the present disclosure relate to apparatus for preventing drain down of fluid in a hydraulic system. In particular, some examples of the present disclosure relate to apparatus for preventing drain down of oil in a hydraulic valvetrain system. Non-limiting examples will now be described with reference to the accompanying drawings.

The figures illustrate an apparatus 10 for a hydraulic valvetrain system 90 comprising: a first oil retaining means 12; a first oil conveyance means 14 operably connected to the first oil retaining means 12; a second oil conveyance means 16 having a first end 18 operably connected to the first oil conveyance means 14; and a second oil retaining means 20; wherein a second end 22 of the second oil conveyance means 16 is located within the second oil retaining means 20. The second oil retaining means 20 has a non-permeable base 30 and a side wall 32 to provide a receptacle 34 in which to retain oil.

Figure 2:
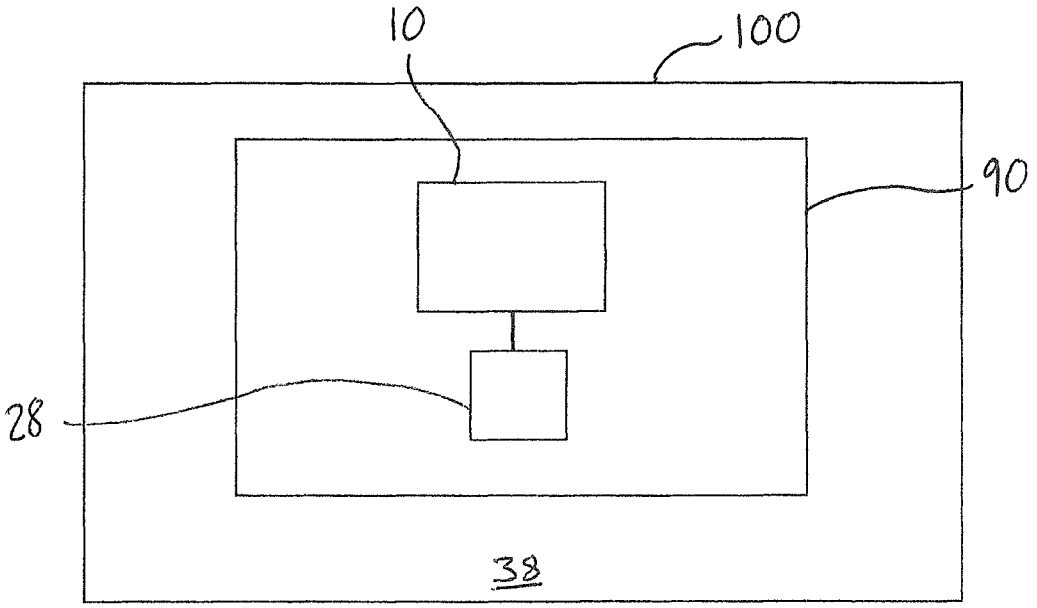
FIG. 2 illustrates a schematic view of an internal combustion engine.
Figure 3:
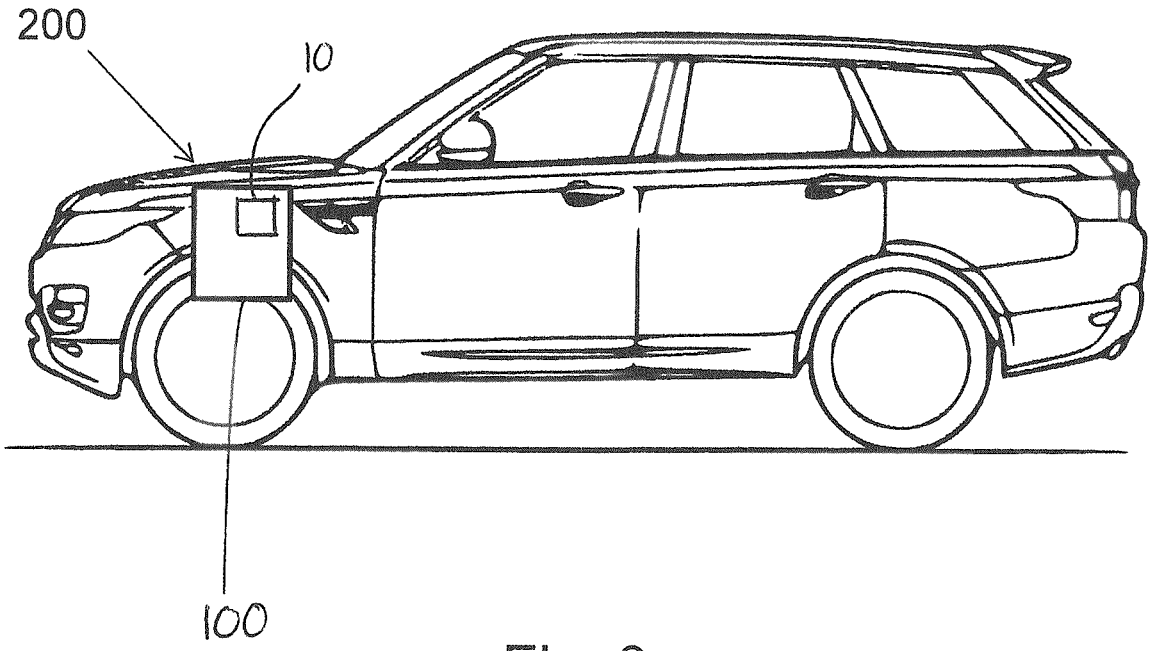
FIG. 3 illustrates an example vehicle.

FIG. 1 is a schematic illustration of an apparatus 10 comprising a first oil retaining means 12 in the form of a first oil reservoir, which may be called a middle pressure chamber or medium pressure chamber, which may form part of a hydraulic valvetrain system 90 in the form of a continuous variable valve lift system. The hydraulic valvetrain system 90 may form part of an internal combustion engine 100. FIG. 2 illustrates the apparatus 10 as part of a hydraulic valvetrain system 90 in an internal combustion engine 100. As illustrated in FIG. 3, the internal combustion engine 100 may be located in a vehicle 200 to provide motive force to the vehicle 200.

In FIG. 1 two first oil retaining means 12 are illustrated, however, in other examples, any number of first oil retaining means 12 may be comprised in the apparatus 10, without affecting the function of the apparatus 10. For simplicity, the description below describes the interrelationship between a second oil retaining means 20 and a single first oil retaining means 12.

As shown in FIG. 1, the first oil retaining means 12 is in the form of a first oil reservoir, having a base 24 which may be operably connected to a valve 28, a pump piston 48 and a brake unit 50. In some embodiments different components may be operably connected to the base 24 of the first oil retaining means 12, and the components illustrated within the dashed area of FIG. 1 are not considered to be essential to the claimed invention, but are merely intended to be illustrative of components which could be connected to the first oil retaining means 12. Furthermore, for simplicity, the components in the dashed area are not shown for the other illustrated first oil retaining means 12. The valve 28 may be a solenoid valve for control of a brake unit 50. The connection to the valve 28 at the base 24 provides an oil flow path through an oil flow aperture 26. Since the valve 28 must have finite clearance between moving parts, an oil leakage path along or through which oil may pass even when the internal combustion engine 100 is at standstill is provided. Further leakage gaps downstream of the valve 28, provided for instance by or at a pump piston 48 and/or a brake unit 50, allow for oil to drain from the first oil retaining means 12 at engine standstill. Where oil leaks through the oil leakage path and further leakage gaps, air can be introduced into the apparatus 10. The connection to the valve 28 is additionally shown schematically in FIG. 2. The first oil retaining means 12 functions to retain a lubricant in the form of oil, or similar chemical compound, for lubrication of the valve 28. First oil retaining means 12 functions to retain fluid for actuation and lubrication of a hydraulic valvetrain system 90.

In FIG. 1 the first oil retaining means 12 is operably connected to a first oil conveyance means 14 in the form of a de-aeration gallery such that air, introduced into the first oil retaining means 12 during operation of the hydraulic valvetrain system 90, can be purged from the first oil retaining means 12, thus maintaining operation of the hydraulic valvetrain system 90 within desired or expected parameters. The first oil retaining means 12 may be directly connected to the first oil conveyance means 14, or there may be one or more intervening components.

The first oil conveyance means 14 allows transportation of oil to and from the first oil retaining means 12 for the de-aeration of oil from the first oil retaining means 12. Since the first oil retaining means 12 is arranged to provide for the de-aeration of oil, it is often called a de-aeration line or de-aeration gallery. In FIG. 1 the first oil conveyance means 14 is also operably connected to a second oil conveyance means 16. The second oil conveyance means 16 is in the form of a tube, hose or conduit suitable for transportation of oil at temperatures exhibited by the oil in the hydraulic valvetrain system 90.

The second oil conveyance means 16 comprises a tube, hose or conduit with a first end 18 and a second end 22 and having a first axis 42 defined therebetween, such that the flow of oil passing through the second oil conveyance means 16 is along the first axis 42. In other examples, the second oil conveyance means 16 may define a tortuous path between the first end 18 and the second end 22, thus providing for a longer oil flow path between the first oil retaining means 12 and the second oil retaining means 20. The second oil conveyance means 16 may be directly connected to the first oil conveyance means 14 or there may be one or more intervening components. The function of the second oil conveyance means 16 is to allow the transportation of oil to and from a second oil retaining means 20.

The first end 18 of the second oil conveyance means 16 is, in use, at an altitude or elevation which is higher than the second end 22 of the second oil conveyance means 16, such that oil flows under gravitational force or action from the first end 18 to the second end 22.

The second end 22 of the second oil conveyance means 16 is located within a second oil retaining means 20. The second oil retaining means 20 provides a reservoir for oil and comprises a base 30 and side wall 32, providing a receptacle 34 to hold or retain oil. The base 30 and side wall 32 may be flat, curved, or of any other form in order to provide a receptacle 34 for oil. The second oil retaining means 16 has an open top 36, or alternatively a top portion with apertures, to allow egress of oil from the second oil retaining means 20. When located in an internal combustion engine 100, oil is allowed to flow out of the second oil retaining means 20 via the open top 36 to an engine sump 38 which is located below the level of the second oil retaining means 20, as shown in FIG. 2. Oil which flows out from the open top 36 of the second oil retaining means 20 flows under gravitational force or action to the engine sump 38, for further use in the lubrication of engine components.

In FIG. 1, the second oil retaining means 20 is located below the first oil retaining means 12 in order to assist in the creation of a hydrostatic pressure balance within the hydraulic valvetrain system 90, in particular between the first oil retaining means 12 and the second oil retaining means 20. The purpose and operation of this arrangement will be further described below with regards to FIGS. 4 to 6.

In other examples, the second oil retaining means 20 may be only partially located below the first oil retaining means 12. The altitude or elevation of at least a portion of the second oil retaining means 20 may be lower than the first oil retaining means 12, that is, lower than the base 24 of the first oil retaining means 12 in order to create or facilitate a hydrostatic pressure balance within the apparatus 10.

An opening 40 in the second end 22 of the second oil conveyance means 16 is located within the receptacle 34 of the second oil retaining means 20 adjacent to the base 30 of the second oil retaining means 20 to allow a flow of oil through the second oil conveyance means 16 to and from the second oil retaining means 20. A gap 44 between the opening 40 and the base 30 of the second oil retaining means 20 allows substantially free flow of viscous fluid such as oil between the second oil conveyance means 16 and the second oil retaining means 20.

Figure 4:
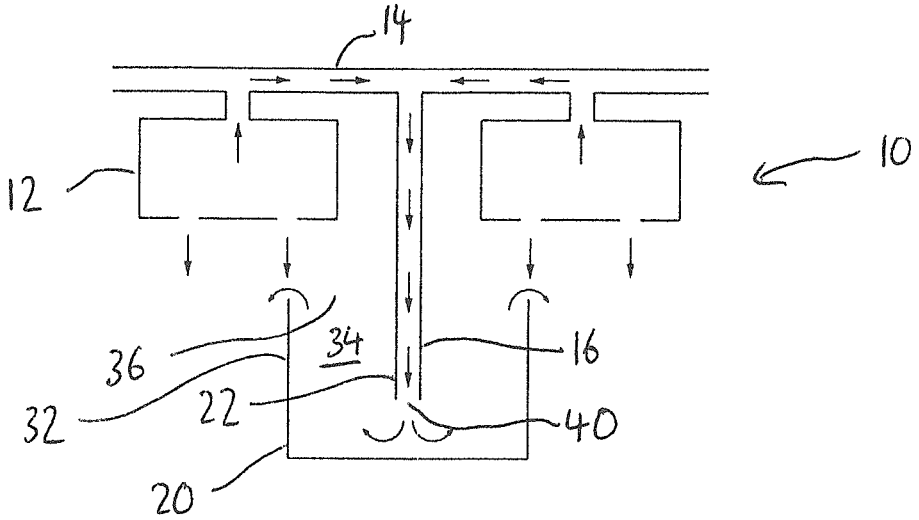
FIG. 4 illustrates a schematic view of the apparatus of FIG. 1 in an engine running condition.
Figure 5:
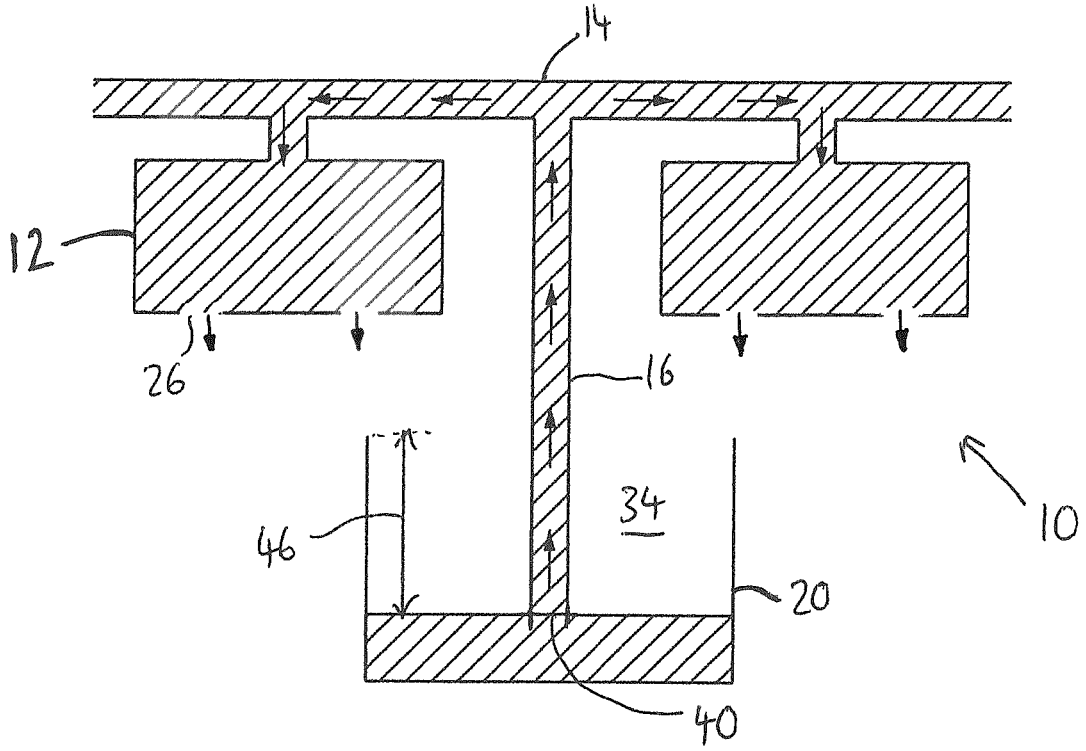
FIG. 5 illustrates a schematic view of the apparatus of FIG. 1 on engine stop.
Figure 6:
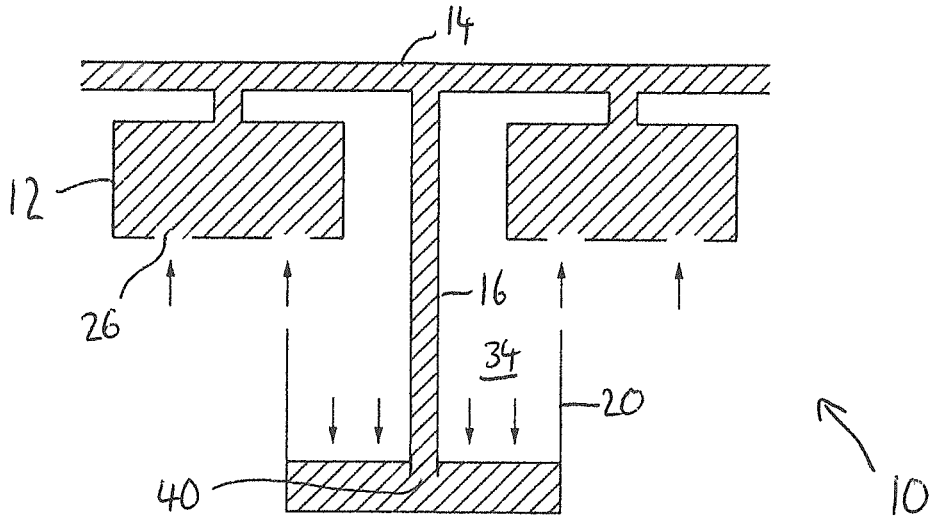
FIG. 6 illustrates a schematic view of the apparatus of FIG. 1 during engine standstill.

FIGS. 4, 5 and 6 illustrate an example apparatus at various times in the operation of the hydraulic valvetrain system 90 of an internal combustion engine 100.

In FIG. 4 the internal combustion engine 100 is running such that valve actuation is occurring. In FIG. 4, under the engine running condition, aerated oil flows out of the first oil retaining means 12 via the first oil conveyance means 14 and the second oil conveyance means 16, and through the opening 40 at the second end 22 of the second oil conveyance means 16 to the second oil retaining means 20. The second oil retaining means 20 receives oil in the receptacle 34. The oil accumulates in the second oil retaining means 20 until it reaches the open top 36 of the second oil retaining means 20, where excess oil is caused to flow over the side wall 32, flowing under gravitational force or action to the sump 38 of the internal combustion engine 100 below. The flow of oil during engine running is illustrated by directional arrows in FIG. 4.

In FIG. 5 the internal combustion engine 100 is, or has been, caused to stop, such that valve actuation is no longer occurring. Following engine stop, the oil within the apparatus 10, and in the internal combustion engine 100 in general, begins to cool. The temperature decreases from a temperature which was achieved during engine operation towards an ambient temperature, that is, a temperature external to the internal combustion engine 100, such as an outside air temperature.

In FIG. 5 it is shown that during the cooling cycle, oil in the apparatus 10, which includes oil in the first oil retaining means 12, contracts. During contraction, oil from the second oil retaining means 20 is drawn up against the force or action of gravity through the opening 40 of the second oil conveyance means 16, up the second oil conveyance means 16 towards the first oil conveyance means 14 and the first oil retaining means 12. During cooling from the temperature which was achieved during engine operation to an ambient temperature, the oil contracts by an oil contraction volume, which is dependent on the volume of oil in the apparatus 10 and by the physical properties of the oil, which are for example defined by the specification or grade of oil. It can be seen from FIG. 5 that the level of the oil has been reduced by a distance 46 determined from, at least, the oil contraction volume and the configuration of the second oil retaining means 20. The flow of oil, during the cooling cycle, is illustrated by directional arrows in FIG. 5.

The minimum temperature may be an ambient temperature experienced by a non-operational hydraulic valvetrain system 90 and may vary depending on environmental conditions. It may therefore be considered that a minimum temperature of the oil may be an expected minimum temperature in which the hydraulic valvetrain system 90 is expected to operate.

The second oil retaining means 20 acts as an oil reservoir for maintaining the oil level in the first oil retaining means 12, such that on subsequent engine start up, immediate valve lift in the hydraulic valvetrain system 90 can be achieved. The volume of the receptacle 34 retaining oil in the second oil retaining means 20, above the opening 40 in the second oil conveyance means 16, is arranged or configured to be greater than the expected oil contraction volume over an application specific temperature range, that is, between a maximum oil temperature, for example as experienced during engine operation, and a minimum oil temperature, for example an ambient temperature following engine shutoff, thus avoiding drawing in of air through the opening 40 which would lead to pressure imbalance in the apparatus 10 and drainage of the oil via the flow aperture 26 of the first oil retaining means 12. The expected oil contraction volume may be based on a calculated oil contraction volume. The calculated oil contraction volume may be based on one or more of the expected working temperature range of the oil, the internal volume of at least the first oil retaining means 12, the first oil conveyance means 14 and the second oil conveyance means 18, and the oil specification.

In one example embodiment the difference between the maximum oil temperature and the minimum oil temperature is 120° C. With such a temperature decrease, the contraction in oil volume, in one non-limiting example, may be twenty four cubic centimetres.

It will be understood that the contraction in oil volume is dependent, at least, on the volume of oil in the hydraulic valvetrain system 90 and the specific compound or grade of oil being used, and that the configuration of the second oil retaining means 20 will be chosen to account for the specific hydraulic valvetrain system 90 configuration and compound or grade of oil used. Thus with a decrease in volume of twenty four cubic centimetres, the volume of the second oil retaining means 20 in which oil can be retained above the opening 40 in the second end 22 of the second oil conveyance means 16 would have to be greater than twenty four cubic centimetres in order to avoid air being drawn into the apparatus 10 allowing drain down of oil from the first oil retaining means 12.

In FIG. 6, the engine is at standstill and the temperature of the oil has reached ambient temperature, such that no further significant oil contraction would be expected. In this engine standstill state a hydrostatic pressure balance is achieved, where pressure on the oil in the second oil retaining means 20 balances with pressure at the oil flow aperture 26 in the first oil retaining means 12, such that oil is prevented from leaving the first oil retaining means 12 through the oil flow aperture 26. In this state no air can escape from the apparatus 10 meaning that no air can be drawn into the first oil retaining means 12.

Figure 7:
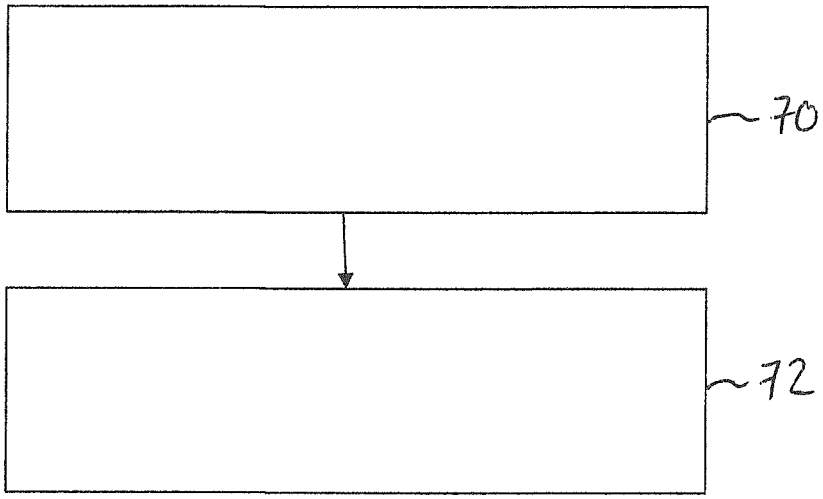
FIG. 7 illustrates an example method.

FIG. 7 illustrates a flow chart of an example method of retaining oil in a hydraulic valvetrain system 90. The method may in some examples be performed by the apparatus 10.

The method of retaining oil in a hydraulic valvetrain system 90 comprises, at block 70, receiving, in a second oil retaining means 20 during operation of the hydraulic valvetrain system 90, oil from a first oil retaining means 12 via a first oil conveyance means 14 and a second oil conveyance means 16, the second oil conveyance means 16 having a first end 18 operably connected to the first oil conveyance means 16 and a second end 22 located within the second oil retaining means 20.

At block 72 the method comprises receiving, in the first oil retaining means 12 following cessation of operation of the hydraulic valvetrain system 90, oil from the first oil conveyance means 14, wherein, upon contraction of the oil volume during reduction of oil temperature, oil from the second oil retaining means 20 passes into the second oil conveyance means 16 to prevent air entering the hydraulic valvetrain system 90.

The blocks illustrated in FIG. 7 may represent steps in a method. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus for a hydraulic valvetrain system, the apparatus comprising:

a first oil retaining means;

a second oil retaining means; and an oil conveyance means having a first end operably connected to the first oil retaining means and a second end operably connected to the second oil retaining means; wherein the second oil retaining means is configured to receive oil from the first oil retaining means via the oil conveyance means during operation of the hydraulic valvetrain system;

the first oil retaining means is configured to receive oil from the oil conveyance means following cessation of operation of the hydraulic valvetrain system; and upon contraction of an oil volume during a reduction of oil temperature, oil from the second oil retaining means passes into the oil conveyance means to prevent air entering the hydraulic valvetrain system;

the first oil retaining means comprises an oil flow aperture through which oil can pass; and the second oil retaining means is arranged to provide a pressure balance to prevent oil leakage through the oil flow aperture.

2. The apparatus for a hydraulic valvetrain system according to claim 1, wherein the second oil retaining means is at least partially located below the first oil retaining means.

3. The apparatus for a hydraulic valvetrain system according to claim 1, wherein the oil conveyance means comprises a first oil conveyance means and a second oil conveyance means.

4. The apparatus for a hydraulic valvetrain system according to claim 3, wherein the first oil conveyance means comprises an oil discharge line, an oil discharge port, a de-aeration line, or a de-aeration gallery.

5. The apparatus for a hydraulic valvetrain system according to claim 3, wherein the second oil conveyance means comprises a tube, a hose or a conduit.

6. The apparatus for a hydraulic valvetrain system according to claim 1, wherein the first oil retaining means is a first oil reservoir and the second oil retaining means is a second oil reservoir.

7. The apparatus for a hydraulic valvetrain system according to claim 1, wherein the first oil retaining means is operably connected via the oil flow aperture to at least one of the group consisting of a valve, a piston, and a brake unit; and the connection between the first oil retaining means and the one of the group provides an oil flow path.

8. The apparatus for a hydraulic valvetrain system according to claim 1, wherein the second oil retaining means comprises an open top configured to allow egress of oil from the second oil retaining means to an engine sump.

9. The apparatus for a hydraulic valvetrain system according to claim 1, wherein the second end of the oil conveyance means comprises an opening located below a top of the second oil retaining means.

10. The apparatus for a hydraulic valvetrain system according to claim 9, wherein a retainable level of oil in the second oil retaining means above the level of the opening is such that a retained volume of oil above the opening is greater than the oil contraction volume in the hydraulic valvetrain system between a maximum oil temperature and a minimum oil temperature.

11. The apparatus for a hydraulic valvetrain system according to claim 10, wherein a difference between a maximum oil temperature and a minimum oil temperature is between 60° C. and 180° C.

12. A hydraulic valvetrain system comprising the apparatus according to claim 1.

13. An internal combustion engine comprising the hydraulic valvetrain system according to claim 12.

14. A vehicle comprising the internal combustion engine according to claim 13.

15. A method of retaining oil in a hydraulic valvetrain system, the method comprising:

receiving, in a second oil retaining means during operation of the hydraulic valvetrain system, oil from a first oil retaining means via an oil conveyance means, the oil conveyance means having a first end operably connected to the first oil retaining means and a second end operably connected to the second oil retaining means;

providing a pressure balance, using the second oil retaining means, to prevent oil leakage through an oil flow aperture of the first oil retaining means through which oil can pass; and following cessation of operation of the hydraulic valvetrain system, receiving, in the first oil retaining means oil from the oil conveyance means, wherein, upon contraction of an oil volume during reduction of oil temperature, oil from the second oil retaining means passes into the oil conveyance means to prevent air entering the hydraulic valvetrain system.

* * * * *